US005617752A

United States Patent [19]

Hill et al.

[11] Patent Number: 5,617,752

[45] Date of Patent: Apr. 8, 1997

[54] METHODS OF AND APPARATUS FOR STRAIGHTENING RODS

[75] Inventors: Bobby D. Hill, Amory; Daniel M. Harrell, Ripley, both of Miss.

[73] Assignee: Emhart, Inc., Newark, Del.

[21] Appl. No.: 518,345

[22] Filed: Aug. 23, 1995

[51] Int. Cl.[6] ..... B21D 3/10

[52] U.S. Cl. ..... 72/98

[58] Field of Search ..... 72/95, 98, 100, 72/160, 164, 111; 140/147

[56] References Cited

U.S. PATENT DOCUMENTS

| | | | |
|---|---|---|---|
| 202,978 | 4/1878 | Atwood | 72/111 |
| 1,188,461 | 6/1916 | McCain | 72/95 |
| 3,277,682 | 10/1966 | Kaestner | 72/164 |
| 3,492,850 | 2/1970 | Groppini . | |
| 3,688,539 | 9/1972 | Hogarth | 72/164 |
| 3,812,700 | 5/1974 | Horton . | |
| 3,998,083 | 12/1976 | Dilling . | |
| 4,287,743 | 9/1981 | Hantschk . | |
| 4,388,818 | 6/1983 | Krapfenbauer | 72/95 |

*Primary Examiner*—Lowell A. Larson
*Attorney, Agent, or Firm*—E. D. Murphy

[57] ABSTRACT

A rod-straightening apparatus 28 includes a movable collet unit 30 for gripping a butt end 24 of a rod 20 to be straightened. The rod 20 extends from the collet unit 30 in a cantilevered fashion to a tip end 26 of the rod. An intermediate portion of the rod 20 is located in a straightener mechanism 32 which includes five spaced, non-rotatable, stationary, straightening blocks 96 located along one side of the intermediate portion of the rod. Four spaced, non-rotatable, movable, straightening blocks 99 are located the opposite side of the intermediate portion of the rod 20 opposite the spaces between the five stationary blocks. The movable blocks 99 are supported on a slide member 140 which is controlled to move the blocks into a position adjacent the intermediate portion of the rod 20 after the intermediate portion has been positioned adjacent the fixed blocks 96. Each of the blocks 96 and 99 is formed with a groove 106 of semi-circular cross section to form a confined passage. A hydraulic cylinder 204 is controlled to move the collet unit 30 in a direction away from the blocks 96 and 99 and a rotary hydraulic motor 58 associated with the collet unit is controlled to rotate a collet 60. During this action, the rod 20 is rotated and the section thereof between the intermediate portion and the tip end 26 is moved through the confined passage defined by the grooves 106 to effect the straightening thereof.

22 Claims, 6 Drawing Sheets

METHODS OF AND APPARATUS FOR STRAIGHTENING RODS

BACKGROUND OF THE INVENTION

This invention relates to methods of and apparatus for straightening rods and particularly relates to methods and apparatus for straightening tapered mandrels used in the manufacture of non-metallic composite shafts for golf clubs.

Many mechanisms and devices include rods of selected cross sectional configurations which, desirably, have a linear axis from a first end to a second end thereof. The rods could be solid or hollow in tubular fashion. The rods could also be referred to as shafts, tubes, mandrels, pipes, elongated members or the like. In any event, in order for the mechanisms and devices to function properly, the axis of each of the rods must be linear.

In one process for manufacturing golf clubs, a tapered shaft is formed from a non-metallic material such as, for example, graphite and has a club head assembled at a tip end of the shaft and a grip assembled at a butt end of the shaft. A shaft of this type is commonly referred to as a composite shaft. In order for the club to function properly when used by a golfer, the axis of the composite shaft must be straight. Thus, during the process of manufacturing the composite shaft, critical attention must be directed to insuring that the axis of the resultant shaft is linear.

When making a composite shaft, graphite ribbons are wrapped around a solid metal mandrel of a prescribed length. Each of the ribbons also includes a plurality of spaced, parallel, plastic fibers which extend along the length of the ribbon or on a bias to the length of the ribbon. A heat-shrinkable plastic is wrapped around the assembly of the mandrel and the ribbons. The assembly is then processed through a heated environment where the graphite composite becomes liquid and the heat-shrinkable plastic shrinks to a desired size to confine the liquid graphite composite to the desired size. The assembly is then removed from the heated environment and is cooled whereby the graphite cures in the shape defined by the heat shrunk plastic. The plastic and the mandrel are removed and the resultant composite shaft is processed further to finish the shaft for use as a shaft of a golf club.

It is apparent from the foregoing description of the manufacture of the composite shaft that the straightness, or non-straightness, of the axis of the mandrel establishes the resultant straightness, or non-straightness of the axis of the shaft. If the mandrel is not axially linear, the shaft likewise will not be axially linear and will have to be discarded. Thus, it is critically important that the axis of the mandrel be straight when the mandrel is to be used in the manufacture of the composite shaft.

Mandrels which are used in the manufacture of composite shafts for golf clubs are typically solid and are formed with a first or large diameter end and a second or small diameter end with a sidewall which tapers inwardly from the first end to the second end thereof. The tapered sidewall is circular or round and the axis is desirably straight or linear. The large diameter of the mandrel could be, for example, 0.5 inch and the small diameter could be, for example, 0.125 inch while the length could vary within a range from 39 inches to 45 inches. With such small diameters, and with a relatively long length, it is not uncommon for the mandrels to bend slightly during handling and storage. This is particularly so along a length of about eighteen inches as measured from the small diameter end toward the other end. In order to insure that each mandrel is formed with a linear axis during manufacture of the shaft, the mandrel should be processed through a mandrel-straightening apparatus before the graphite ribbons are wrapped onto the mandrel.

A device for straightening tapered elongated elements is disclosed in U.S. Pat. No. 3,998,083 and includes structure for rotating and advancing the element along a longitudinal axis. The element is located within a sheath composed of a coiled spring construction during the straightening operation. During the straightening operation, the sheath with the tapered element assembled therein is processed through an universal mechanism where the tapered element is bent back and forth across its axis. A device of this type is complex and expensive. Further, such a device requires considerable load and unload time thereby limiting the number of elements which can be straightened within a given period of time.

Other straightening devices are shown and described in U.S. Pat. Nos. 3,492,850 and 4,287,743, each of which use rollers which bear against the element to be straightened as the element is moved adjacent the rollers. Still another straightening device is shown and described in U.S. Pat. No. 3,812,700 wherein an element to be straightened is moved through a drum which contains spaced radially-inwardly directed straightening members. As the drum is rotated and the element is pulled through and along the axis of the drum, the members engage the bent, out-of-axis portions of the element and urges the portions toward the drum axis to thereby straighten the element. Each of these devices are also complex and expensive while requiring significant loading and unloading time. Also, due to the individual movement of the element-engaging structure with the elements during the straightening operation, the element could be subject to unwanted stresses during the operation.

In any event, there is a need for an apparatus for straightening rods and the like, such as tapered mandrels for example, in an inexpensive and uncomplicated manner while avoiding placing unnecessary stresses on the rod during the straightening operation. In addition, there is a need for an apparatus for straightening only selected portions of rods where out-of-axis bending is likely to occur rather than randomly along the entire length of the rod.

SUMMARY OF THE INVENTION

In view of the foregoing needs, it is an object of this invention to provide a simple and inexpensive apparatus for and method of straightening rods.

Another object of this invention is to provide an apparatus and method of straightening axially a selected portion of the total length of a rod.

Still another object of this invention is to provide an apparatus and method for straightening axially a selected portion of a tapered rod such as, for example, a solid tapered mandrel used in the manufacture of a composite shaft.

A further object of this invention is to provide an apparatus for and a methods of straightening axially rods without placing unnecessary stresses upon the rods during the straightening process.

With these and other objects in mind, this invention contemplates an apparatus for straightening a rod having a first end and a second end spaced therefrom to insure that an axis which extends between the first and second ends is linear. The apparatus includes a support for gripping the first end of the rod in such a fashion that a remainder portion of the rod between and including the second end thereof extends in cantilever from the gripped first end. The apparatus further includes a first straightening block and a second straightening block which are stationary during a straightening operation. The first straightening block is located adjacent a first side of the rod along the remainder portion and the second straightening block is located adjacent a second side of the rod along the remainder portion. A moving mechanism is coupled to the support to selectively move the support and thereby move the rod in a direction whereby the second end of the rod trails the first end thereof. In this manner, the sections of the remainder portion of the rod are moved axially past the first and second straightening blocks to effectively and axially straighten any segments of the sections which are not in a desired linear axial alignment of the rod.

This invention further contemplates a method of straightening a rod having a first end and second end spaced therefrom and an axis extending therebetween. The method includes the steps of locating a first straightening block adjacent a first side of the rod intermediate the first and second ends of the rod and a second straightening block is located adjacent a second side of the rod intermediate the first and second ends thereof. The blocks are maintained in a stationary condition while the rod is moved in a direction where the second end of the rod trails the first end thereof. The first and second straightening blocks are initially located adjacent the rod in such a position that any section of the rod which is being moved adjacent the first and second blocks which is not in axial alignment with a desired linear axis of the rod will engage the first and/or second blocks and straightened for linear axial alignment.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
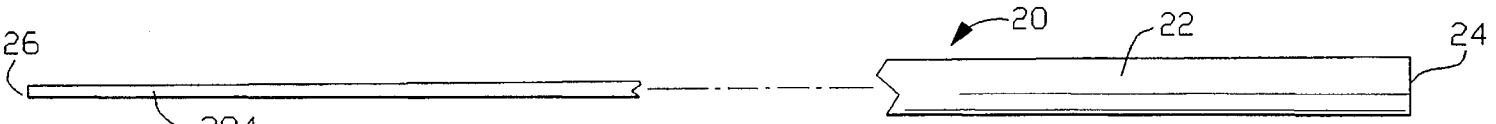
FIG. 1 is side view showing a rod or mandrel with a center portion broken away to illustrate the length of the mandrel.

Referring to FIG. 1, a rod or mandrel 20 is formed from solid metal stock and is formed with a side surface 22 which is uniformly tapered from a large-diameter end 24 to a small-diameter end 26. For illustration purposes, a center portion of mandrel 20 has been removed in order to show the opposite ends 24 and 26 thereof. However, it is to be understood that mandrel 20 is of continuous, unbroken length.

Mandrel 20 is used in the manufacture of a composite, or plastic, shaft (not shown) which forms a component part of a golf club (not shown). Composite shafts are formed, for example, by wrapping fiber-containing graphite ribbons around mandrel 20 and wrapping a heat-shrinkable plastic around the assembly of the mandrel and graphite ribbons. The assembly is then heated to liquify the graphite and to shrink the plastic generally in the shape of the ultimate shaft to be formed thereby. The heated assembly is cooled to cure the graphite. The plastic and the mandrel 20 are removed from the cured graphite which is then processed to finalize the manufacture of the shaft. The length of the mandrel 20 is controlled by the length of the composite shaft to be manufactured by use of the mandrel.

It is critically important that the shaft be linear along its axis from one end to the other end thereof. Further, the exterior surface from one end to the other end thereof must be of a uniform taper. In order to accomplish these requirements for the manufacture of a usable shaft, mandrel 20 must also have a linear axis from end 24 to end 26 thereof. In the course of handling many of the mandrels 20 in shipping, storage and shaft manufacturing, the portions of the mandrel which extend axially inwardly from end 26 tend to be bent out of axial alignment primarily due to the extremely small diameter adjacent end 26. In order to return the bent mandrels 20 to their axial or straight state, the mandrels must be processed through a mandrel-straightening operation.

Figure 2:
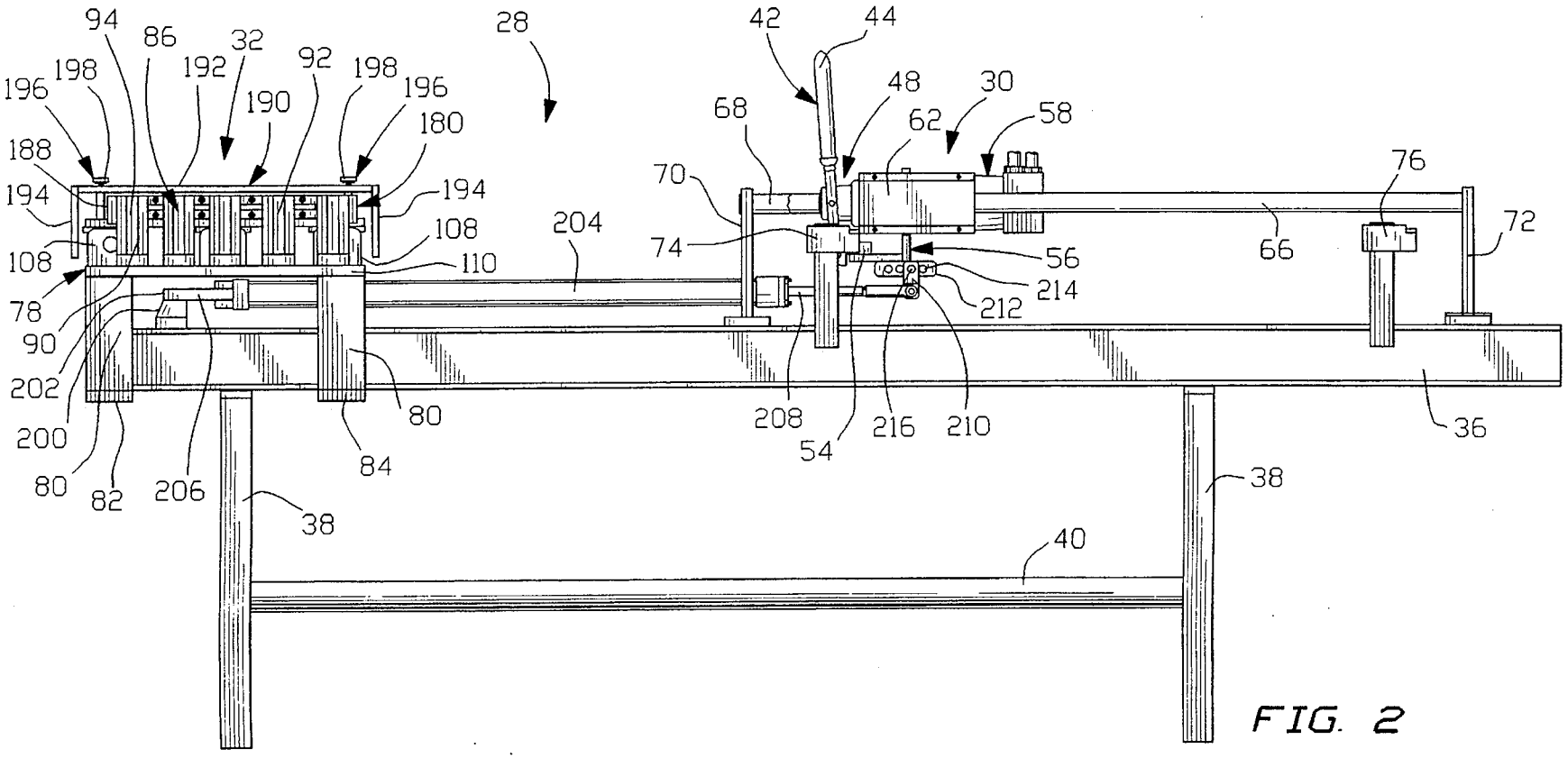
FIG. 2 is a front view showing an apparatus for straightening the mandrel of FIG. 1 in accordance with certain principles of the invention.
Figure 3:
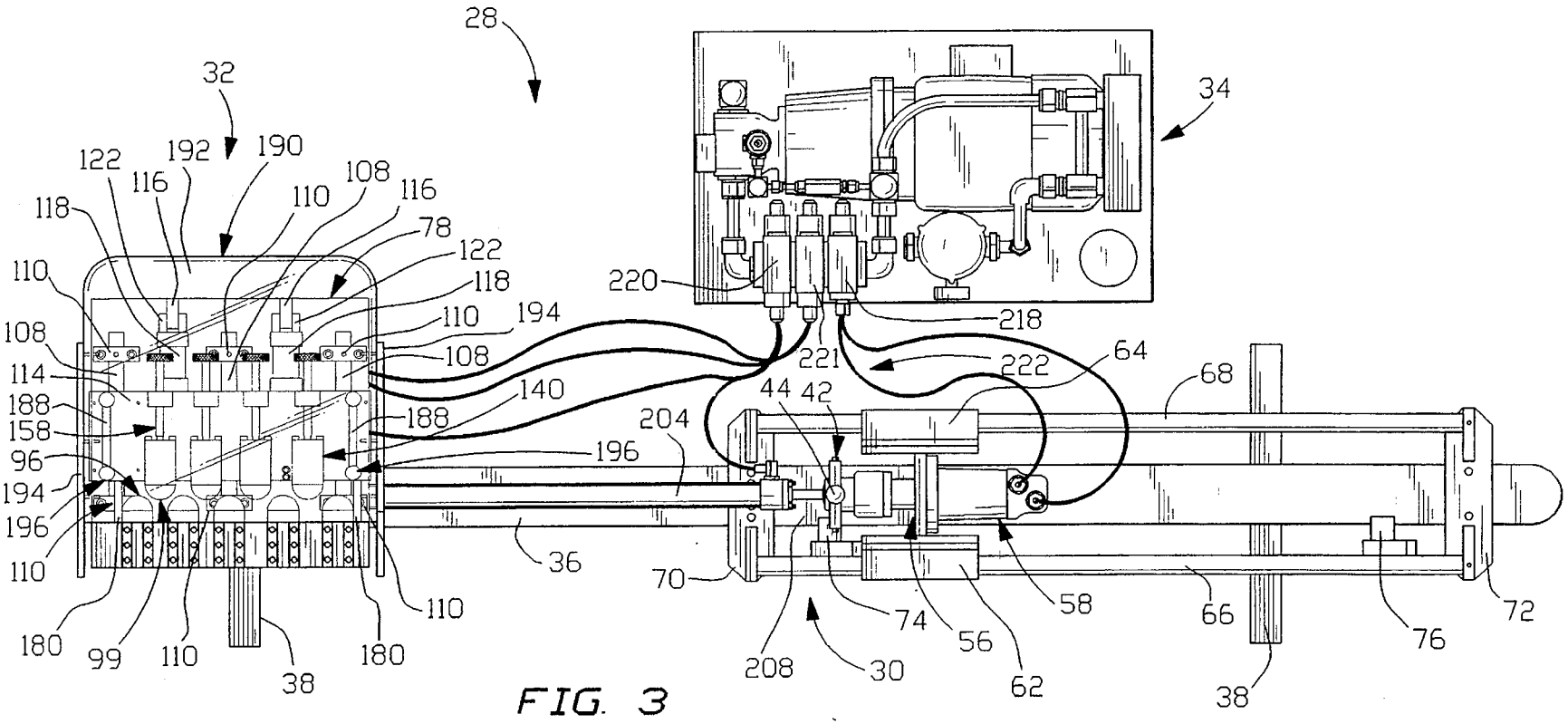
FIG. 3 is a top view showing the apparatus of FIG. 2 for straightening the mandrel of FIG. 1.
Figure 4:
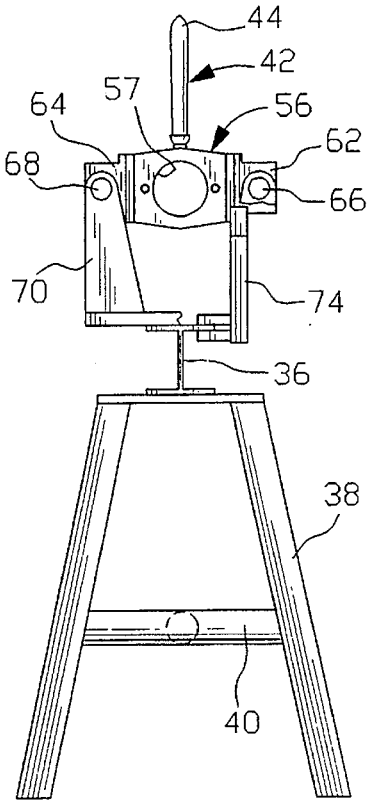
FIG. 4 is an end view showing portions of the apparatus of FIG. 2 with parts removed to clearly selected features in accordance with certain principles of the invention.

As viewed in FIG. 3, an apparatus 28 for straightening rods, such as mandrel 20, includes a collet unit 30 for supporting the large-diameter end 24 during a straightening operation. Apparatus 28 further includes a straightener mechanism 32 for receiving and straightening a portion of the mandrel adjacent the small-diameter end 26. Apparatus 28 also includes an electrical/hydraulic supply and control system 34 for facilitating and controlling the straightening operation. As shown in FIGS. 2, 3 and 4, apparatus 28 is supported on an "I" beam 36 which, in turn, is supported on a pair of spaced vertical stands 38 held together by several braces 40.

Figure 8:
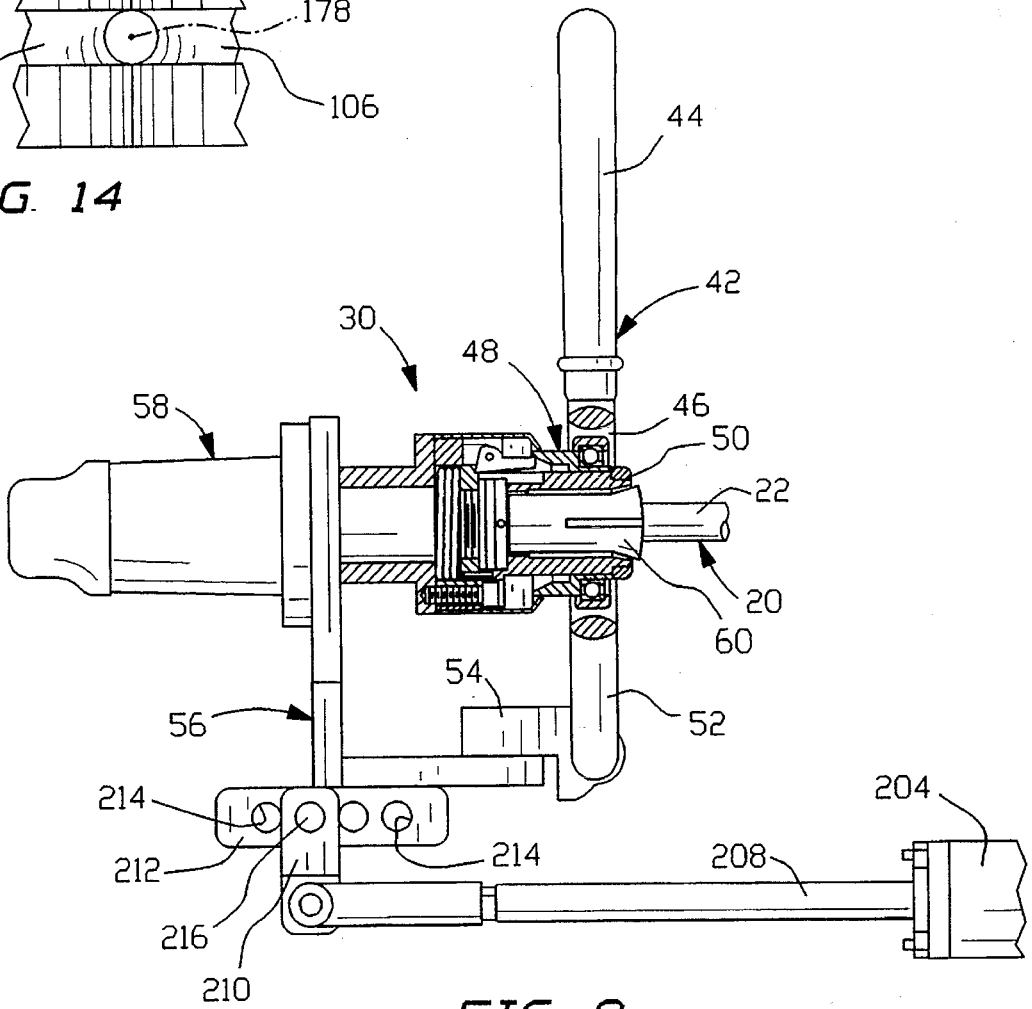
FIG. 8 is a partial sectional side view of a mandrel-gripping collet which forms a portion of the apparatus of FIG. 2.

Referring to FIG. 8, collet unit 30 includes a pivotal handle 42 which is formed with a handle portion 44 and has an intermediate portion 46 attached to a collet support 48 at one end 50 of the collet support. A lower end 52 of handle 42 is attached for pivotal movement to a bracket 54 which is fixedly attached to a coupler mounting 56. Coupler mounting 56 is formed with a circular opening 57 (FIG. 4) which facilitates fixed securance of the mounting with an outer housing of a rotary hydraulic motor 58 which is coupled to collet support 48 to facilitate rotary movement of the collet support when controlled to do so. As shown in FIG. 8, a collet 60 is located within collet support 48 and end 24 of mandrel 20 is located within the collet. Handle 42 has been positioned to facilitate the gripping of end 24 of mandrel 20 by collet 60 so that, upon activation of rotary motor 58 to rotate collet support 48, the mandrel is also rotated.

Figure 10:
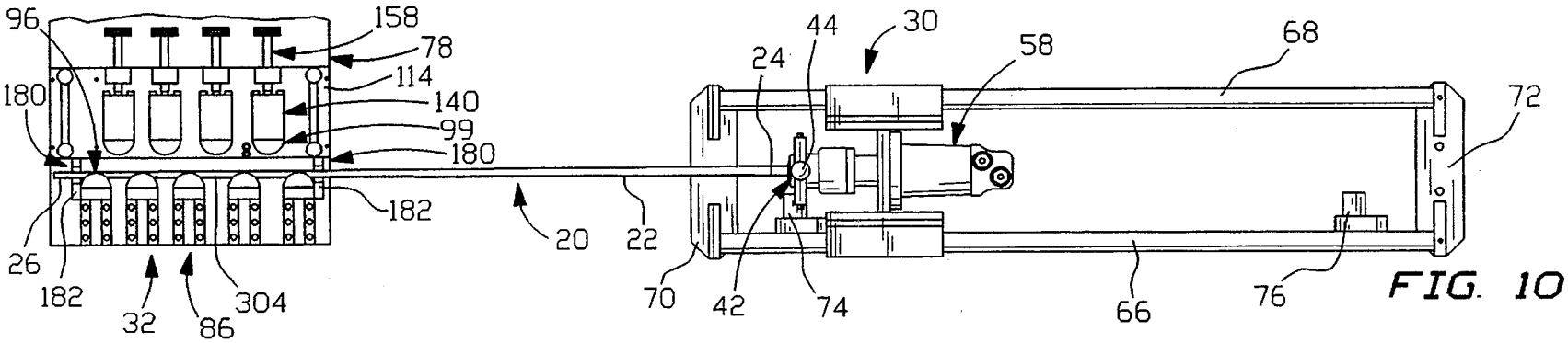
FIG. 10 is a diagrammatical view showing an assembly of the mandrel of FIG. 1 mounted in the apparatus of FIG. 2 prior to the initiation of a mandrel-straightening operation.
Figure 11:
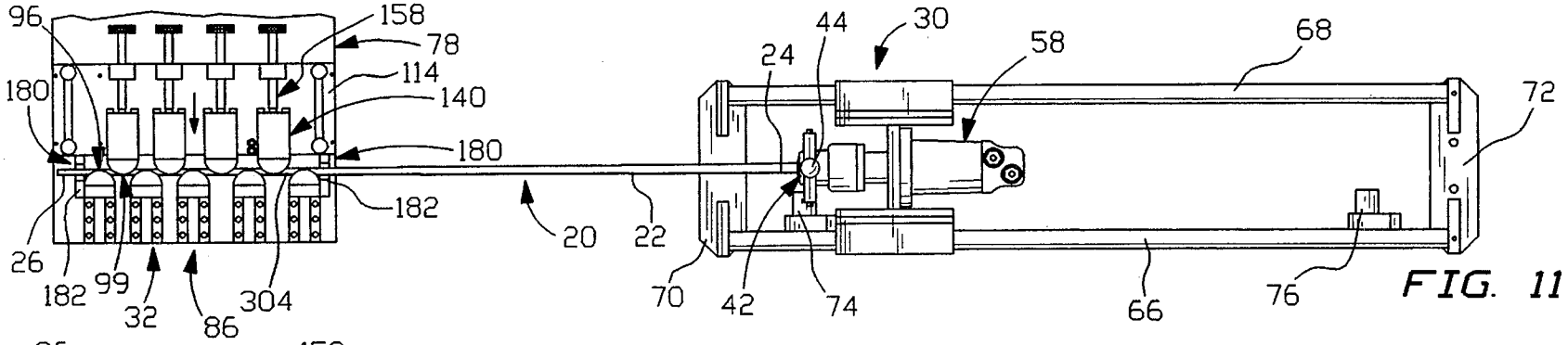
FIG. 11 is a diagrammatical view showing the assembly of FIG. 10 with the straightening mechanism of FIG. 5 moved into place in anticipation of a mandrel-straightening operation.
Figure 12:
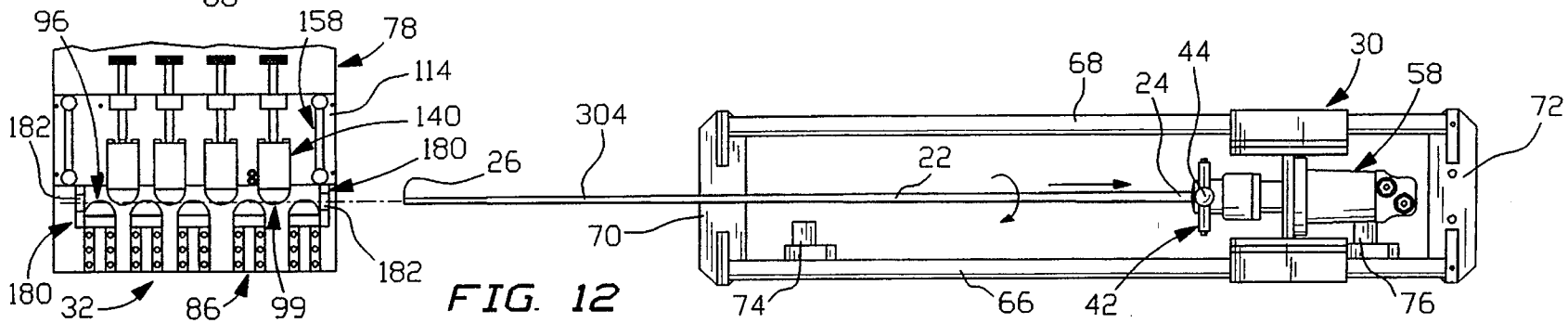
FIG. 12 is a diagrammatical view showing the assembly of FIG. 10 following completion of a mandrel-straightening operation.

Referring to FIG. 3, coupler mounting 56 extends between and is attached to spaced interfacing walls of a pair of slidable bushings 62 and 64 which are mounted for movement on guide rods 66 and 68, respectively. Rods 66 and 68 are mounted at opposite ends thereof to a pair of spaced end supports 70 and 72, respectively, which are mounted fixedly on the top of "I" beam 36. During the course of a mandrel-straightening operation, collet unit 30 is moved from a "loading" position as illustrated in FIGS. 3, 10 and 11 to a "home" position as illustrated in FIG. 12. As shown in FIG. 3, a first limit switch 74 is attached to "I" beam 36 adjacent the "loading" position of the collet unit 30 and a second limit switch 76 is located adjacent the "home" position of the collet unit to establish the limits of travel of the collet unit between the "loading" and "home" positions.

Figure 5:
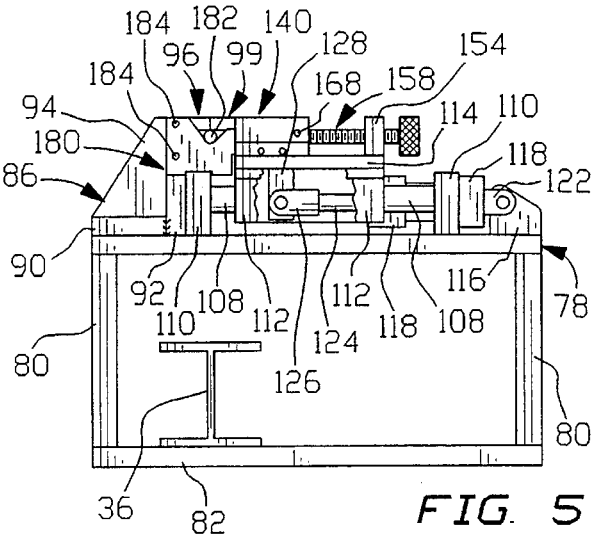
FIG. 5 is a side view showing a straightening mechanism which forms a portion of the apparatus of FIG. 2 in accordance with certain principles of the invention.

Referring to FIGS. 2 and 5, straightening mechanism 32 is mounted on a platform 78 which is supported by four legs 80 located on the underside of the platform at the four corners thereof. The bottoms of two of the four legs 80 are attached to opposite ends of a cross member 82 and the other two of the four legs are similarly attached to opposite ends of a cross member 84. Cross members 82 and 84 are secured to the underside of "I" beam 36 which facilitates the support of platform 78 and straightening mechanism 32 in a position spaced above the top of the "I" beam as illustrated in FIG. 2.

Figure 13:
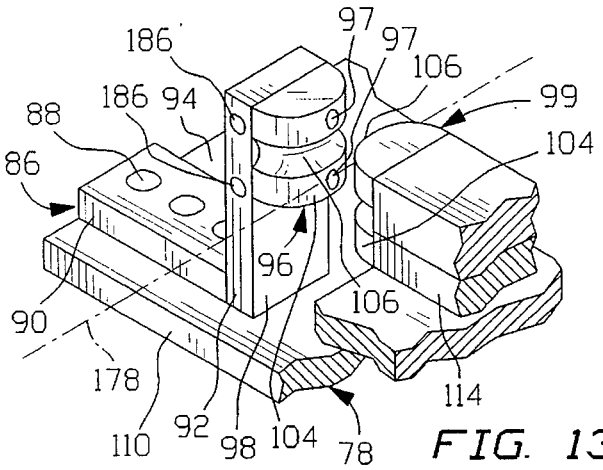
FIG. 13 is a partial perspective view showing the relationship between mandrel-straightening blocks of the straightening mechanism of FIG. 5 in accordance with certain principles of the invention.

As shown in FIG. 3, five straightening-block supports 86 are mounted on and secured in a stationary position to the top of platform 78 along one edge thereof and are equally spaced from each other. One of the supports 86 is illustrated in FIG. 13 to clearly show the manner of mounting the support on platform 78 by use of bolts 88. Each support 86 includes a horizontal member 90 secured to a vertical member 92 with an angled brace 94 attached therebetween for strengthening purposes. As further shown in FIG. 13, a stationary straightening block 96 is formed with a pair of vertically-spaced countersunk through holes 97. The straightening block 96 is secured to an inboard face 98 of vertical member 92 by a pair of bolts 100 (FIG. 6) which are placed through holes 97 and threadedly into threaded holes (not shown) formed in face 98 of vertical member 92. It is to be understood that the stationary straightening blocks 96 which are secured to supports 86 by bolts are identical to a movable straightening block 99 illustrated in FIG. 6 to be described hereinafter.

In the preferred embodiment, straightening blocks 96 and 99 are composed of polyurethane with a 75D hardness. However, other suitable materials could be used without departing from the spirit and scope of the invention.

The straightening blocks 96, which are mounted on the five supports 86 as shown in FIGS. 3, 10, 11 and 12, form a group of five straightening blocks which are stationary and which are uniformly spaced from the adjacent stationary blocks as a part of the straightening mechanism 32.

Figure 6:
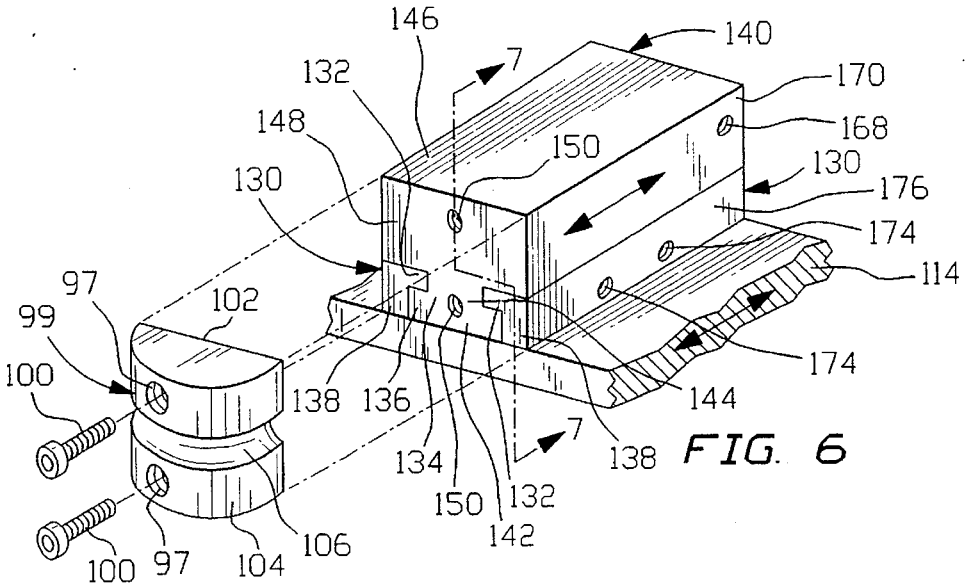
FIG. 6 is a perspective view showing selected portions of the straightening mechanism of FIG. 5 in accordance with certain principles of the invention.

As shown in FIGS. 6 and 13, each of the blocks 96 and 99 is formed with a flat face 102 on one side thereof and a generally half circular face 104 on the other side thereof. A concave, annular groove 106, which is generally formed with a semicircular cross section, is formed in the circular face 104 and is located in a horizontal plane when assembled in the straightening mechanism 32.

As shown in FIG. 3, three parallel, spaced guide rods 108 are each supported at opposite ends thereof by a respective one of three pairs of spaced rod supports 110 which are mounted in fixed fashion to spaced portions of the top of platform 78. One of the three rods 108 and its respective pair of spaced supports 110 is shown in FIG. 5 with a central portion of the rod broken away to show other elements of the straightening mechanism 32.

As further shown in FIG. 5, a pair of spaced bushings 112 are attached to the underside of a slide platform 114 and rod 108 is positioned through the bushings to facilitate movement of the slide platform along the rod. Additional bushings (not shown), which are identical to bushings 112, are also attached to the underside of platform 114 to receive the remaining two rods 108 in the same manner whereby the three rods provide substantial sliding support for the platform.

Figure 7:
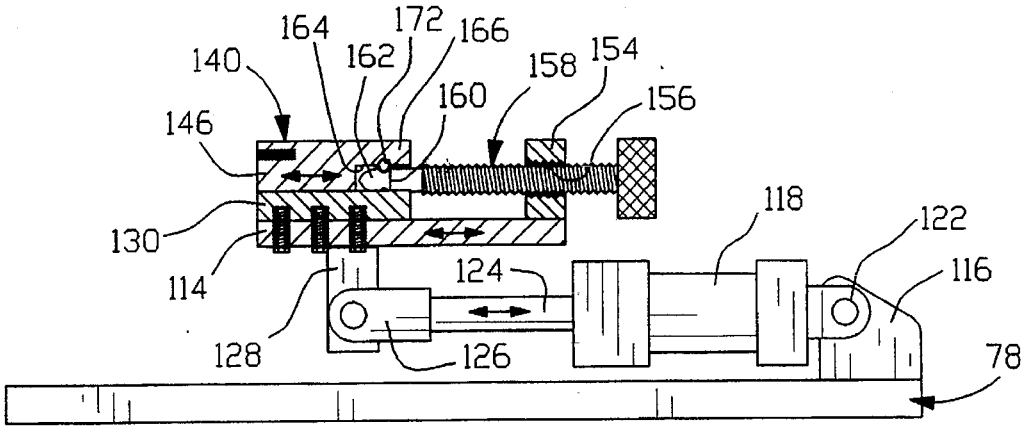
FIG. 7 is a side view showing selected features of the straightening mechanism of FIG. 5 in accordance with certain principles of the invention.

As shown in FIG. 3, a pair of spaced coupling supports 116 are mounted on the rear of the top of platform 78. A pair of hydraulic cylinders 118 each include a yoke 122 which extends from the rear thereof and which straddle and are pivotally secured to a respective one of the supports 116. Referring to FIGS. 5 and 7, a piston rod 124 (one shown) extends forwardly from each of the hydraulic cylinders 118 and has a yoke 126 attached to the forward end thereof. Each of the yokes 126 straddles and is attached to a coupling support 128 which is attached to the underside of slide platform 114. As hydraulic cylinders 118 are operated in a forward or reverse direction, piston rods 124 are moved forwardly and in reverse, respectively, whereby slide platform 114 is moved forwardly and in reverse, respectively.

As shown in FIG. 6, and as partially shown in FIG. 7, a pair of spaced, L-shaped guide members 130 are mounted fixedly in an inverted position on top of slide platform 114 with end faces of horizontal legs 132 of the guide members being in interfacing but spaced relation to each other. With this arrangement, a narrow space 134 is formed between the interfacing end faces of the legs 132 and a wider space 136 is formed between interfacing portions of vertical legs 138. A slide member 140 is formed with a lower portion 142 which fits into space 136, and intermediate portion 144 which fits into space 134 and an upper portion 146 which located on the top surfaces of L-shaped members 130 for sliding movement relative thereto.

As shown in FIG. 6, slide member 140 is formed with a front face 148 having a pair of spaced vertically-aligned threaded holes 150. Movable straightening block 99 is also formed with the pair of countersunk, vertically-aligned through holes 97, each of which are in horizontal alignment with a respective one of threaded holes 150. Flat face 102 of block 99 is placed in facing engagement with face 148 of slide member 140 and bolts 100 are placed through holes 97 and threadedly into holes 150 to secure the block with the slide member in this assembly.

As shown in FIG. 7, a stand 154 is mounted on the rear top of slide platform 114 and is formed with a threaded hole 156. An adjusting screw 158 is threadedly mounted in hole 156 and is formed with an narrow neck 160 and an enlarged head 162 at the forward end thereof. An opening 164 is formed in a rear face 166 slide member 140 for receipt of head 162 and neck 160 of screw 158. A threaded hole 168 (FIG. 6) is formed in a side face 170 (FIG. 6) to receive a threaded pin 172 which locates adjacent neck 160 of screw 158 to retain the screw with slide member 140 but allow rotatable movement of the screw within opening 164.

If subsequent adjustment of slide member 140 and straightening block 99 is required relative to L-shaped guide members 130, adjusting screw 158 is adjusted appropriately to attain the required adjustment. As shown in FIG. 6, a pair of threaded holes 174 are formed in a side face 176 of one of the L-shaped members 130 to receive a pair of set screws (not shown) which engage a face of slide member 140 and thereby secure the slide member in the adjusted position relative to the L-shaped members.

Figure 14:
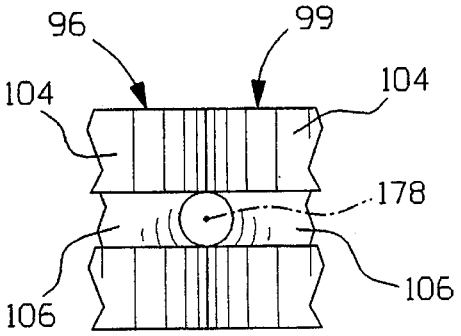
FIG. 14 is a partial side view showing further the relationship between the mandrel-straightening blocks of the straightening mechanism of FIG. 5 in accordance with certain principles of the invention.

As illustrated in FIGS. 3, 10, 11 and 12, four movable, uniformly spaced, straightening blocks 99 are mounted on slide platform 114 in the manner described above and move in unison by virtue of their mounting on the slide member. The four movable straightening blocks 99 are situated in alignment with the spaces between the five stationary straightening blocks 96 as illustrated in FIG. 10 and are movable to a mandrel-straightening position where the forward ends of the blocks 99 are locatable slightly within the spaces between the blocks 96 as viewed in FIGS. 3, 11 and 12. In the mandrel-straightening position, the forward portions of the generally semicircular grooves 106 of blocks 96 and 99 are horizontally aligned about an axis 178, as shown in FIG. 14, to generally form a circular passage along the axis which is spatially bordered on one side thereof by the five blocks 96 and by the four blocks 99 on the other side thereof.

Referring to FIG. 5, each of a pair a nesting members 180 (one shown) is formed with a generally V-shaped nest 182 and with a pair of mounting holes 184. As shown in FIG. 13, the outboard face of vertical member 92 of the block support 86 at one end of the row of five block supports is formed with a pair of threaded holes 186. Referring again to FIG. 5, one of the nesting members 180 is mounted to this end support 86 by use of screws (not shown) so that the bottom of the nest 182 is aligned with the lowest portion of the circular passage formed by the semicircular grooves 106 or the blocks 96 and 99. The other nesting member 180 is mounted on the outboard face (not shown) of the block support 86 at the other end of the row of supports 86 in similar fashion.

As shown in FIG. 2, two spacer bars 188 are located vertically on and are attached to opposite sides of the upper surface of slide platform 114. A clear plastic safety shield 190 having a top panel 192 and two side panels 194 is placed on the two spacer bars 188. Screws 196 with heads 198 are placed through holes (not shown) in the top panel and are threaded into the threaded holes (not shown) of the side bars 188 to secure the shield 190 in place as shown. The forward edges of side panels 194 are formed with accommodating slots (not shown) to clear the mandrel 20 when it is nested in the straightening mechanism 32.

Referring to FIG. 2, a stand 200 is mounted on the top of "I" beam 36 beneath mandrel-straightening mechanism 32 and supports a bracket 202 which extends horizontally therefrom. A long hydraulic cylinder 204 has an arm 206 at one end thereof which is attached to bracket 202. A piston rod 208 extends from the opposite end of cylinder 204 and is attached to an adjusting element 210 which is more clearly shown in FIG. 8. A plate 212 is formed with four spaced holes 214 and is attached to coupler mounting 56. By use of a connecting pin 216, element 210 can be positioned adjacent any one of the four holes 214 and coupled to the plate and, thereby, to coupling mounting 56. When cylinder 204 is activated to move piston rod 208 in one direction or the other, collet unit 30 is moved accordingly between the limits established by switches 74 and 76. Switches 74 and 76 are adjustably positioned on "I" beam 36, and element 210 can be connected to plate 212 through any one of the four holes 214, to accommodate different lengths of mandrels 20 to be straightened.

Referring to FIG. 3, the electrical/hydraulic supply and control system 34 includes a first electrically-controlled solenoid valve 218 for controlling the feeding of hydraulic fluid to rotary motor 58. A second electrically-controlled solenoid valve 220 controls the feeding of hydraulic fluid to cylinder 204 and a third electrically-controlled solenoid 222 controls the feeding of hydraulic fluid to cylinders 118.

Figure 9:
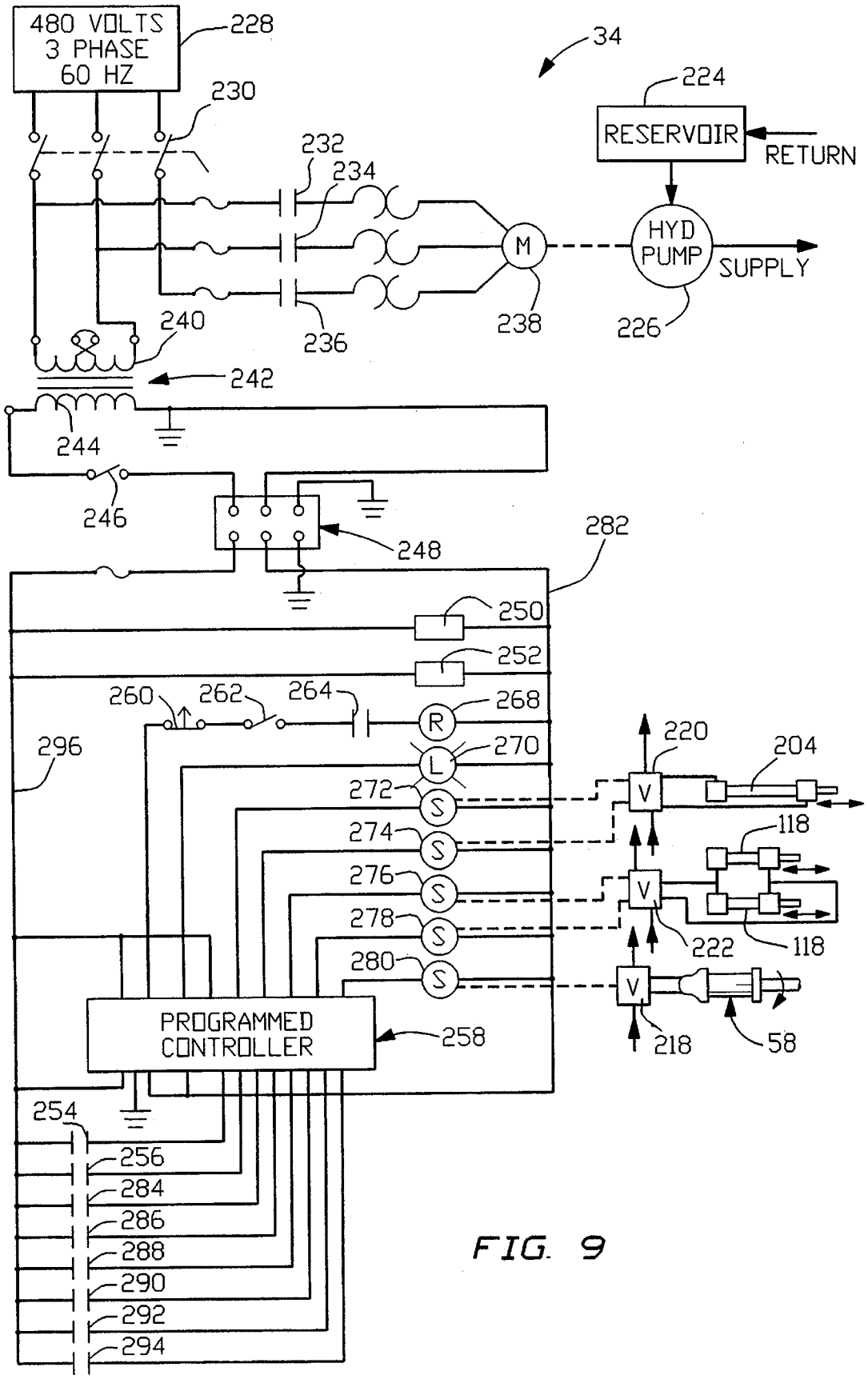
FIG. 9 is an electrical/hydraulic schematic showing the manner of providing power for and controlling the operation of the apparatus of FIG. 2 in accordance with certain principles of the invention.

Referring to FIG. 9, a power supply 228, which is a 440 volts, 3-phase, 60 hertz source, provides the operating power for the apparatus 28. A mains switch 230 is used to connect power supply 228 to control system 34. The 3-phase voltage of power supply 228 is connectable through three relay contacts 232, 234 and 236 to a two horse power motor 238 for selective operation of the motor. Motor 238 drives a hydraulic pump 226 which draws pressurized hydraulic fluid from a reservoir 224 and supplies the fluid to various hydraulically operated devices as described below.

One side of the 3-phase supply 228, which provides a 110 volts source, is connected to the primary 240 of a control transformer 242. The secondary 244 of transformer 242 is connectable through a switch 246 and then through a surge-protector filter 248 to the main portion of control system 34.

Control system 34 includes a pair of optical sensors 250 and 252 which facilitate control of a pair of respective contacts 254 and 256, respectively.

As further illustrated in FIG. 9, a programmable controller 258 serves as the heart of control system 34 and responds to the operation of various switches and contacts, as described below, for controlling operation of the straightener apparatus 28. Controller 258 can be of the type identified as a Model SLC 500 which is available from Allen-Bradley Co. whose address is 1201 South Second Street, Milwaukee, Wis. 53204.

Control system 34 further includes an emergency switch 260, a guard detector switch 262, a contact 264 associated with switch 246 and a relay coil 268, all connected in series. Emergency switch 260 is located physically and electrically to allow an operator to interrupt the operation of the straightener apparatus 28 in the event of an emergency. Guard detector switch 262 closes when safety shield 190 is installed on straightening mechanism 32 of the straightener apparatus 28 and shields the operator during a straightening operation. If the shield 190 is mistakenly not installed and the operator attempted to start the operation of the straightener apparatus 28, switch 262 remains open and the straightener apparatus will not operate.

Control system 34 also includes a lamp 270, and five solenoids 272, 274, 276, 278 and 280 each of which is connected on one side to controller 258 and on the other side to a neutral line 282 of the 110 volts source.

A plurality of contacts 284, 286, 288, 290, 292 and 294, as well as contacts 254 and 256, are each connected on one side the controller 258 and on the other side to 110 volts power line 296.

On the hydraulic side, the three valves 218, 220 and 222 are controlled by solenoids 272, 274, 276, 278 and 280 to operate the collet linear-drive cylinder 204, the pair of straightener head cylinders 118 and collet rotary-drive cylinder 58. Pressurized hydraulic fluid is pumped to valves 218, 220 and 222 by hydraulic pump 226 whereby the fluid is returned from the valves to reservoir 224.

When an operator of the straightener apparatus 28 is to initiate operation, the operator must place both hands, or some portion thereof, over the optical sensors 250 and 252 (which are physically located on a control unit) to facilitate closure of respective contacts 254 and 256 and thereby condition controller 258 to initiate operation of the straightener apparatus 28 when other necessary conditions are met.

To operate the straightener apparatus 28, the operator closes switch 230 and switch 246. Upon closure of switch 246, contact 264 closes and, assuming switches 260 and 262 are closed, voltage is applied to relay coil 268. At this time, contacts 232,234 and 236 close to facilitate application of operating voltage to motor 238 and to start operation of pump 226 for the purpose described above. In addition, contact 294 closes which indicates to controller 258 that hydraulic pump 226 is running.

As viewed in FIG. 10, the operator then places the large-diameter end 24 of the tapered mandrel 20 to be straightened into collet 60 (FIG. 8) on a collet unit 30 which is located at a "loading " station at the collet unit's closest position to the straightener mechanism 32. Spaced portions of the trailing section 304, which extends about eighteen inches from the small-diameter end 26 of the mandrel 20, are positioned generally into the V-shaped nests 182 of the spaced nesting members 180 on the straightener mechanism 32. This positions the trailing section 304 of the mandrel 20 adjacent to the spaced straightening blocks 96 and 99 which eventually are to be moved toward each other to enclose portions of the trailing section of the mandrel prior to the actual straightening operation. Collet handle 42 is then manually manipulated to clamp the collet 60 into position to grip the large-diameter end 24 of the mandrel 20.

As the mandrel 20 is positioned in the collet unit 30 and extended to the straightener mechanism 32, a proximity switch (not shown) associated with contacts 284 is operated and the contacts are closed to indicate to controller 258 that the mandrel is in place. Also, when the collet handle 42 is moved to the clamped position, a limit switch (not shown) is operated to close associated contacts 292 and thereby indicate to controller 258 that the mandrel 20 has been clamped within the collet unit 30.

Controller 258 has now been informed that all preconditions necessary for axial movement and rotation of the mandrel 20 have been attained and the controller then facilitates illumination of lamp 270 to indicate to the operator that the straightening operation can be initiated.

The operator then places both hands, or some portion thereof, in position to block the optical sensors 250 and 252 whereby respective contacts 254 and 256 are closed. The operator must maintain his or her hands over the sensors 250 and 252 during operation of the straightener apparatus 28. Otherwise, the straightener apparatus 28 will not operate, or will cease operation if either, or both, hands are removed from the position over optical sensors 250 and 252 during operation of the apparatus. This provides a safety feature regarding operation of the straightener apparatus 28 which prevents the operator from placing his or her hands in the path of moving parts during operation of the straightener apparatus.

Controller 258 responds to the closure of contacts 254 and 256 and operates solenoid 276 to control valve 300 and thereby initiate the application of fluid to cylinders 118 to move the straightener mechanism 32 to a position as shown in FIG. 11 so that the straightening blocks 99 are positioned in conjunction with straightening blocks 96 about portions of the trailing end 304 of the mandrel 20 as noted above.

Referring to FIG. 12, controller 258 then controls solenoid 280 (FIG. 9) to operate rotary-drive cylinder 58 to facilitate rotation of the mandrel 20. Solenoid 272 is then operated through controller 258 to operate valve 298 to supply operating fluid to operate cylinder 204 whereby the collet unit 30 is moved in a direction away from the straightener mechanism 32 so that the trailing section 304 of the rotating mandrel 20 is pulled generally along axis 178 (FIGS. 5 and 14) and through a straightening passage defined by the forward portions of grooves 106 (FIGS. 13 and 14) of the non-rotating straightening blocks 96 and 99.

Eventually, the collet unit 32 travels a specified distance as shown in FIG. 12 and pulls the trailing section 304 of the mandrel 20 out of engagement with the straightening blocks 96 and 99 and the straightener mechanism 32. At that time, the collet unit 30 has travelled to its most distant location from the straightener mechanism 32 which is referred to as the "unload" position. At the "unload" position, the collet unit 30 engages the travel-limit switch 76 which is associated with contacts 288 whereby the contacts are closed to indicate to controller 258 that the collet unit has travelled the required distance for the straightening operation. Controller 258 responds and controls solenoid 280 to operate valve 218 to stop the operation of the rotary-drive cylinder 58 and, thereby, the rotation of the mandrel 20. Also, controller 258 facilitates operation of solenoid 278 to control cylinders 118 to move straightener mechanism 32 to its non-straightening or rest position as illustrated in FIG. 10. When this movement is complete, contacts 290 are closed to indicate that the straightener mechanism 32 is at its non-straightening position.

The operator then removes his or her hands from optical sensors 250 and 252 whereby respective contacts 254 and 256 are opened to preclude any further operation of the straightener apparatus 28. The operator then releases the collet 60 from the gripped position by manipulation of handle 42 and removes the straightened mandrel 20 from the straightener apparatus 28 whereby proximity-switch contacts 284 and "collet open" contacts 292 are opened. In response to the opening of contacts 284 and 292, controller 258 then senses that the collet unit 30 is at the "unload" position and that the straightened mandrel 20 has been removed from the collet unit. This conditions controller 258 to be responsive to the returning of the operator's hands to cover optical sensors 250 and 252 whereby respective contacts 254 and 256 are again closed. Controller 258 then controls solenoid 274 to operate valve 220 to thereby reverse the fluid flow in cylinder 204 to move the collet unit 30 toward the straightener mechanism 32.

Eventually, the collet unit 30 reaches the "load" position as illustrated in FIG. 10 and engages the limit switch 74 whereby contacts 286 are closed to indicate to controller 258 that the straightening cycle is now complete. At this time, controller 258 turns off lamp 270. The operator now initiates the next straightening cycle by loading the next mandrel 20 to be straightened and proceeds as described above.

In general, the above-identified embodiments are not to be construed as limiting the breadth of the present invention. Modifications, and other alternative constructions, will be apparent which are within the spirit and scope of the invention as defined in the appended claims.

What is claimed is:

1. An apparatus for straightening a rod to conform to a desired linear axis where the rod is formed with a first end and a second end spaced from the first end, which comprises:

a support for gripping the first end of the rod in such a fashion that the remainder of the rod extends in cantilever from the gripped first end;

a first non-rotatable straightening block being movable laterally of the desired linear axis and formed with structure positionable adjacent a first section of the portion of the remainder of the rod;

a second non-rotatable straightening block angularly displaced about the desired linear axis from the first straightening block and being formed with structure positioned adjacent a second section of the portion of the remainder of the rod which, in an axial direction, is adjacent the first section of the portion of the remainder of the rod;

the structures of the first and second straightening blocks, when positioned adjacent the first and second sections of the rod-remainder portions, combining to define a confined passage having an axis coincidental with the desired linear axis of the rod and for capturing an adjacent portion of the rod within the confined passage; and a moving mechanism coupled to the support for moving the support and the first end of the rod in an axial direction away from the first and second straightening blocks so that the portion of the rod and the second end of the rod are moved through the confined passage formed by the structures of the first and second straightening blocks to thereby straighten in the desired linear axis at least a length of the rod extending between the portion and the second end thereof.

2. The apparatus as set forth in claim 1, which further comprises:

a rotary drive member for rotating the rod during the period when the length of rod extending between the portion and the second end thereof is being moved through the confined passage.

3. The apparatus as set forth in claim 1, wherein the support includes a collet mechanism which receives the first end of the rod and which can be clamped about, and grip, the first end of the rod.

4. The apparatus as set forth in claim 1, wherein the first straightening block is mounted in a stationary location whereat the first section of the portion of the rod is positioned adjacent the structure of the first block when the first end of the rod is gripped by the support.

5. The apparatus as set forth in claim 1, which further comprises:

a movable platform;

the second straightening block mounted on the movable platform; and a moving mechanism coupled to the platform for moving the platform and the second straightening block to a location whereat the structure of the second block is positioned adjacent the second section of the portion of the rod.

6. The apparatus as set forth in claim 5, which further comprises:

an adjusting mechanism coupled to the platform for precisely locating the second straightening block to insure that the block is properly positioned to assist in the straightening of the rod when the moving mechanism moves the rod.

7. The apparatus as set forth in claim 1, which further comprises:

a nesting member located adjacent the first straightening block for receiving and supporting a section of the remainder of the rod adjacent the section of the portion of the remainder.

8. The apparatus as set forth in claim 1, wherein the first straightening block is formed with a groove having a generally semi-circular cross section.

9. The apparatus as set forth in claim 1, wherein the second straightening block is formed with a groove having a generally semi-circular cross section.

10. The apparatus as set forth in claim 1, which further comprises:

the first straightening block formed with a groove having a generally semi-circular cross section located about a first portion of the desired axis;

the second straightening block formed with a groove having a generally semi-circular cross section located about a second portion of the desired axis spaced from the first portion of the desired axis; and the groove of the first block and the groove of the second block forming the confined passage.

11. The apparatus as set forth in claim 10, which further comprises:

the first block being formed with a curving face and the groove of the first block formed in the curving face; and the second block being formed with a curving face and the groove of the second block formed in the curving face.

12. The apparatus as set forth in claim 1, wherein the first straightening block is stationary and is one of at least two straightening blocks which are stationary and which are spatially located on either side of a space opposite the second straightening block.

13. The apparatus as set forth in claim 1, wherein the second straightening block is movable and is one of at least two straightening blocks which are movable and which are spatially located on either side of a space opposite the first straightening block.

14. The apparatus as set forth in claim 1, wherein the first straightening block is stationary and is one of at least two blocks which are stationary and which define a first space between interfacing surfaces of the at least two stationary blocks and a second space adjacent an opposite side of one of the at least two stationary blocks; and the second straightening block is movable and is one of at least two blocks which are movable and are located opposite the first space and the second space, respectively.

15. The apparatus as set forth in claim 1, which further comprises:

a travel limit system for controlling the moving mechanism to allow the mechanism to move a distance sufficient to move the remainder of the rod adjacent the structure of the first and second straightening blocks to effect the straightening of the portion thereof.

16. A method of straightening a rod to conform to a desired linear axis where the rod is formed with a first end and a second end spaced from the first end, which comprises the steps of:

gripping the first end of the rod;

locating a portion of the rod which is between the first end and the second end thereof adjacent and spaced from a first non-rotatable straightening block which is movable laterally of the desired linear axis toward the portion of the rod;

locating the portion of the rod adjacent a second non-rotatable straightening block which is angularly and axially spaced from the first straightening block;

moving the first block toward the portion of the rod to capture the portion of the rod within a confined passage formed by structure of the first and second blocks when the first block is moved toward the portion of the rod, the confined passage having an axis coincidental with the desired linear axis;

moving the first end of the rod in a direction away from the first and second blocks to move at least a section of the rod which is located between the portion and the second end thereof through the confined passage whereby the blocks engage and straighten the section of the rod.

17. The method as set forth in claim 16, which further comprises the step of:

rotating the rod while the section of the rod is being engaged by the blocks to effect the straightening of the rods.

18. The method as set forth in claim 16, wherein the second straightening block is movable and which further comprises the step of:

moving the second non-rotatable straightening block to a location adjacent the portion of the rod and in spaced relation to the first straightening block.

19. The method as set forth in claim 18, which further comprises the step of:

adjusting the position of the second straightening block prior to moving the second block to the location adjacent the portion of the rod to obtain accurate locating of the second block relative to the portion of the rod to effect straightening of the rod.

20. The method as set forth in claim 16, which further comprises the steps of:

forming rod-engaging grooves in each of the first and second straightening blocks;

positioning the first and second straightening blocks adjacent the portion of the rod to align the grooves to form a confined passage for the rod prior to moving the rod in the direction away from the first and second blocks.

21. The method as set forth in claim 16, which further comprises the step of:

supporting successive sections of the rod between the portion and the second end thereof as the rod is being moved adjacent the first and second blocks to straighten the rod.

22. The method as set forth in claim 16, which further comprises the step of:

controlling the distance of movement of the rod to insure that at least a section of the rod between the portion and the second end thereof is straightened.

* * * * *